United States Patent [19]

Lioy et al.

[11] Patent Number: 4,977,656

[45] Date of Patent: Dec. 18, 1990

[54] NICKEL COATED SHOT BLASTED WEB CONVEYING ROLLER

[75] Inventors: Daniel C. Lioy; Edward F. Hurtubis, both of Rochester; Edward R. Schickler, Webster, all of N.Y.

[73] Assignee: Eastman Kodak Company, Rochester, N.Y.

[21] Appl. No.: 401,883

[22] Filed: Aug. 28, 1989

Related U.S. Application Data

[62] Division of Ser. No. 282,661, Dec. 12, 1988, Pat. No. 4,914,796.

[51] Int. Cl.[5] ..... B21B 27/02

[52] U.S. Cl. ..... 29/121.8; 29/132

[58] Field of Search ..... 29/121.8, 130, 132, 29/121.1, 428, 527.2; 72/53, 340, 366; 427/305, 328, 376.8, 349; 226/193

[56] References Cited

U.S. PATENT DOCUMENTS

| | | | |
|---|---|---|---|
| 1,932,168 | 10/1933 | Adams | 29/121.8 X |
| 2,725,640 | 12/1955 | Voigtman | 29/121.8 X |
| 2,958,742 | 11/1960 | Palmer | 29/121.8 X |
| 3,177,558 | 4/1965 | Gronholz et al. | 29/121.8 |
| 3,405,855 | 10/1968 | Daly et al. | 226/193 X |
| 3,412,479 | 11/1968 | Markovic | 29/121.8 X |
| 3,620,808 | 11/1971 | Monroe, Jr. | 427/328 |
| 3,723,083 | 3/1973 | Ritter, Jr. et al. | 29/121.8 X |
| 4,026,007 | 5/1977 | Brower | 29/121.8 X |
| 4,069,570 | 1/1978 | Pospisil et al. | 29/132 |
| 4,189,815 | 2/1980 | Seelenbinder | 29/121.8 |
| 4,200,389 | 4/1980 | Matsui et al. | 29/121.8 X |
| 4,217,769 | 8/1980 | Damraw | 72/53 |
| 4,426,411 | 1/1984 | Sasaki et al. | 427/349 |

FOREIGN PATENT DOCUMENTS

| | | | |
|---|---|---|---|
| 91816 | 6/1982 | Japan | 72/53 |

*Primary Examiner*—Mark Rosenbaum
*Assistant Examiner*—Peter Dungba Vo
*Attorney, Agent, or Firm*—G. Herman Childress

[57] ABSTRACT

A roller for conveying a web is manufactured by applying a layer of nickel to a steel roller and blasting the surface ofo the nickel layer with steel shot to create on the surface a deep texture with well rounded down features and sharp up features with peaks. The blasted surface is finished with a grinding action for removing the peaks to produce plateaus surrounded by interconnected channels. The interconnected channels of the surface allow air entrained between the roller surface and a web to be vented through the channels while the web is in contact with the roller.

2 Claims, 3 Drawing Sheets

NICKEL COATED SHOT BLASTED WEB CONVEYING ROLLER

This is a divisional of application Ser. No. 07/282,661, filed Dec. 12, 1988. Now U.S. Pat. No. 4,914,796.

BACKGROUND OF THE INVENTION

The present invention relates to a web conveying roller, and a process for the manfacture of a roller used for conveying a web, so that dynamic air entrained between the roller surface and the web can be vented from the roller surface when the roller and web are in contact.

In many manufacturing operations a web is trained around a plurality of rollers as it is conveyed through a series of stations. Some of the rollers are drive rollers used for advancing the web and other rollers are simply idler rollers. Typically the web conveyance system is designed to avoid relative movement between the surface of the rollers and the web in order to avoid scratching or other damage to the web. This is especially important during the menufacture of sensitive materials, such as photographic film, paper and magnetic media where such relative movement can produce a surface defect in the final product. Thus it is desirable that the surface of the rollers be sufficiently smooth to avoid damage to the web by the rollers whether the rollers are drive rollers or idler rollers. At the same time, it is important that there be sufficient friction between the rollers and the web to enable the drive rollers to advance the web and to enable the idler rollers to be rotated by the web at the same surface velocity of the web when the web is in contact with the idler rollers.

In a web transport system using drive or idler rollers air can become entrained between the roller and the surface of the web. More specifically, movement of the web can force air into the entrance nip between the web and the surface of the roller, especially when the web is moving at high speeds. This boundary layer of air can cause at least partial separation between the surface of the web and the surface of the rollers. When this occurs, there is a change in the ability of the drive rollers to advance the web, and the web cannot efficiently rotate the idler rollers. As a result, relative movement can occur between the rollers and the web, causing quality defects in the web.

There have been attempts to solve the problems caused by the boundary layer of air between a roller and the web. One example is set forth in U.S. Pat. No. 4,426,757, issued Jan. 24, 1984 in the names of R. Hourticolon et al. The web guide roller disclosed in such patent has cavities on its outer surface which receive air carried with the moving web. More specifically, the cavities comprise a finely branched network of compression chambers that are arranged on the roller surface between plateau-like smoothly ground and polished areas which contact the web. Air in these chambers is compressed between the web and the roller. Air enters these chambers at the point where the web first contacts the roller, and the air is discharged from the chambers at the point where the web runs off the roller.

It is also known from U.S. Pat. No. 3,405,855, which issued Oct. 15, 1968 in the names of D. A. Daly et al, to provide a plurality of grooves in the surface of a roller to control the air boundary layer. The grooves as disclosed in this patent provide passages for the discharge of the air. These grooves are specially formed in the surface of the roller in a predetermind repeating pattern, e.g., by a cutting operation that is both expensive and time consuming. Also, the shape and size of the grooves must be carefully controlled to avoid leaving undesirable marks in the web transported around the roller. The undesirable marks may comprise impressions resulting from the web pressing against the edges of the grooves. Also the grooves can leave thermal defects caused, for example, by the potion of a web in contact with the roller surface drying differently than the portion of the web over the grooves. Moreover, the resulting patterned marks are more readily observed by the human eye than a random pattern of marks. Thus these marks are clearly undesirable, especially in photographic products such as film or paper.

SUMMARY OF THE INVENTION

It is an object of the invention to control dynamic air entrainment between a roller surface and a moving web. Another object of the invention is to vent air from between a roller surface and a moving web without requiring a specially formed repeating pattern of grooves in the roller.

The present invention relates to an improved process for finishing the surface of a roller used for conveying a web. The process includes the steps of applying a layer of nickel to a metal roller, and then blasting the surface of the nickel layer with steel shot to create on the surface a deep texture with well rounded down features and very sharp up features. Next the surface is ground to remove the sharp up features but without removing more than about 50% of the pattern depth formed by the blasting step to produce plateaus surrounded by interconnected channels.

In another aspect the invention relates to a web conveyance roller having a layer of nickel with generally spherical down features in the nickel layer. Many of the down features overlap to form interconnected channels comprising at least 50% of the surface area of the roller. A plurality of plateaus between the channels comprise at least 20% of the surface area of the roller. Preferably the nickel layer is covered with a hard, durable metal layer.

The invention and its objects and advantages will become more apparent in the detailed description of the preferred embodiments presented below.

BRIEF DESRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

Figure 1:
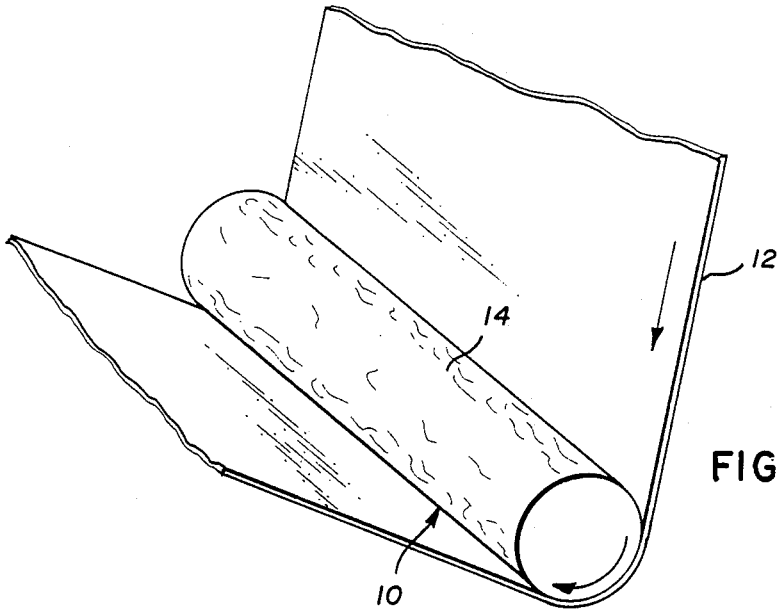
FIG. 1 is a view of a web conveyance roller of the invention with a web trained around a portion of the roller surface.

Referring initially to FIG. 1, a web conveyance roller of the invention, generally designated 10, is rotatable about its longitudinal axis in a clockwise direction as indicated by the arrow. A web 12 is trained around a portion of the roller. Roller 10 can be either a drive roller or an idler roller. In either instance, the velocity of the roller surface and the linear velocity of the web should be equal to each other so that there is no slippage between the roller and the web. This is especially important when the web 12 comprises a material which is easily damaged, such as photographic film, paper, magnetic media or the like. Surface 14 of roller 10 is especially prepared in accordance in the process of the invention to avoid relative movement between the roller and the web.

Figure 2:
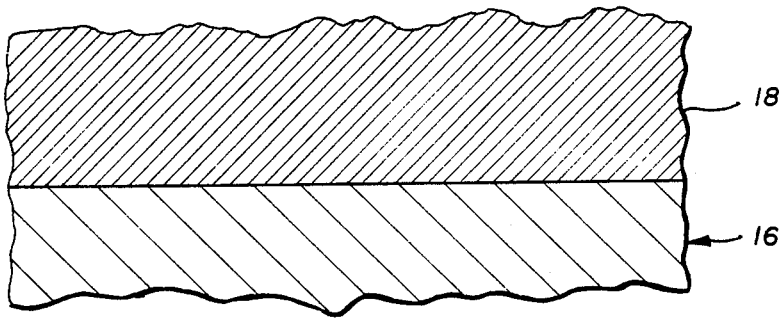
FIG. 2 is an enlarged fragmentary cross section view of a base roller having thereon a layer of nickel.

Referring now to FIG. 2, the process of the invention for manufacturing roller 10 can be applied to cylindrical shells or base rollers of various kinds, such as a plain carbon steel base roller generally designated 16. The length and the diameter of the roller 16 can vary and may, for example, be of a length sufficient to accommodate webs of 8 feet or more in width.

Initially the base roller 16 is coated with a layer of nickel 18. One way to apply layer 18 is to electroplate the layer on the surface. The electroplating process is controlled to provide a nickel layer having a hardness of less than about 50 HRC. "HRC" refers to Rockwell hardness-C scale. While the actual hardness of layer 18 is variable, a hardness above 50 HRC may limit the ability to achieve the desired blasted pattern depth described later in connection with FIG. 3. The thickness of layer 18 also can be varied. The layer thickness should be sufficient to prevent delamination of the layer from the base roller 16, and must be sufficiently thick to enable the shot blasting step to be carried out. A nickel layer of at least 0.004 inches and less than 0.020 inches has been found to be desirable. When nickel layer 18 is applied by an electroplating process, the layer may have a high level of internal residual stress resulting from the electroplating process. Additional internal stress is imparted to layer 18 during the shot-blasting step described later. The combination of the stress resulting from these steps can raise the stress level above the bond strength of the nickel layer to roller 16, causing delamination of layer 18 from the roller.

In order to avoid the possible delamination of an electroplated nickel layer from the roller, it is presently preferred to apply the nickel layer by a metalizing process. More specifically, it is preferred to uniformly coat the nickel layer onto the roller using a plasma spray process. When the nickel layer is applied with the plasma spray it preferably has a thickness of about 0.004 to 0.020 inches.

Figure 3:
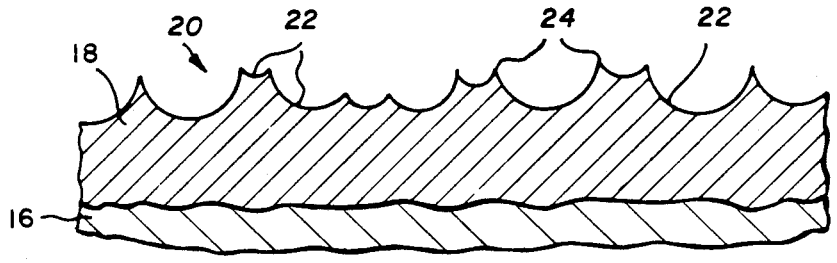
FIG. 3 is a view similar to FIG. 2 but showing the nickel layer of the roller after it has been shot blasted.

The outer surface of the nickel layer is then shot blasted with steel shot to create on the surface a deep texture generally designated 20 in FIG. 3. Surface texture 20 has well rounded down features 22 and very sharp up features designated 24 having peaks. The down features are generally hemispherical in configuration and they extend the full length and circumference of the nickel layer 18.

The hemispherical down features 22 formed during the blasting operation have a depth that is determined by the momentum of the steel shot as its strikes the nickel surface. Preferably the size of the steel shot is substantially uniform so that the mass of each piece of steel shot is also constant. Thus the momentum of the steel shot is dependent only on the velocity of the shot. The velocity of the shot, in turn, is influenced by the nozzle geometry and the blasting pressure utilized. Since the nozzle geometry is constant during the blasting operation, the air pressure used is the only variable that determines the depth of the down features 22. Air pressure is controlled so that it is substantially constant during the blasting operation. Thus the depth of the down features is accurately controlled and a substantially uniform depth is obtained.

The number of down features 22 is determined by the shot size and the pattern depth. The larger the shot size and the deeper the pattern the fewer number of down features 22 will be present on the surface. Thus the number of down features 22 is inherently determined by the shot size and the pattern depth which are held within tight limits. For example, the shot size can range from about 0.006 inches to about 0.080 inches which will produce about 50 to 500 down features per linear inch. Many down features 22 at least partially overlap so that a random pattern of interconnected channels are formed in the surface of the finished roller surface, as described later in regard to FIG. 7.

Figure 4:
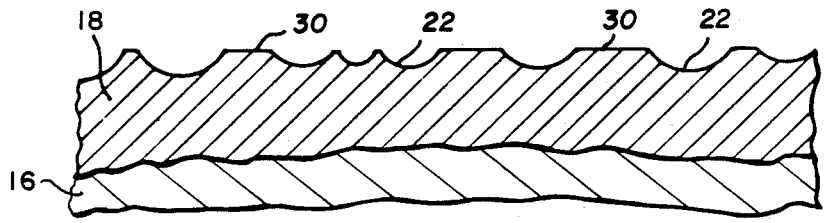
FIG. 4 is a view similar to FIG. 3 after the shot blasted roller has been superfinished.

The next step in preparation of the roller surface is to remove the peaks of the up features 24 and produce plateaus on the surface surrounded by the interconnected channels formed by the down patterns 22. More specifically, the surface shown in FIG. 3 is subject to a superfinishing operation comprising an aggressive multi-direction grinding action which removes peaks 24 from the up features and produces a series of randomly extending plateaus designated 30 in FIG. 4. The roller is rotated during this operation, and the roller rotation rate, the force exerted during grinding, and the grinding rate in a longitudinal direction along the roller surface are all controlled, and are substantially constant, so that there is uniformity in height and smoothness in the plateaus throughout substantially the entire surface of the roller.

The superfinishing step comprises grinding the surface with a series of tapes of successively smaller grit sizes. For example, the surface can initially be ground using a 15 micron tape which establishes the plateaus shown at 30. This is followed by grinding with a 9 micron tape which eliminates scratches on the plateaus caused by use of the courser 15 micron tape. Next the surface is ground using a 3 micron tape to remove the smaller scratches produced by the 9 micron tape. The final step of the superfinishing operation comprises polishing the surface to round the edges of the plateaus so they do not scratch the web. This is preferably accomplished using a slurry comprising a suspension of 9 micron aluminium oxide polishing compound in water.

The final pattern depth and the amount of channeling formed by interconnection of the down features 22 is controlled by removing a predictable amount of material from the blasted pattern shown in FIG. 3. The greater the reduction in pattern depth during the superfinishing stage, from the "as blasted" pattern depth shown in FIG. 3, the less channeling will be present. The reduction in channeling may be excessive if more than 50% of the depth of the down features 22 is removed by the superfinishing operation. On the other hand, in order to eliminate the scratch potential of the shot blasted surface texture, it is preferred that at least 20% of the FIG. 3 pattern depth be removed and that the plateaus have well rounded edges after the superfinishing step.

Figure 5:
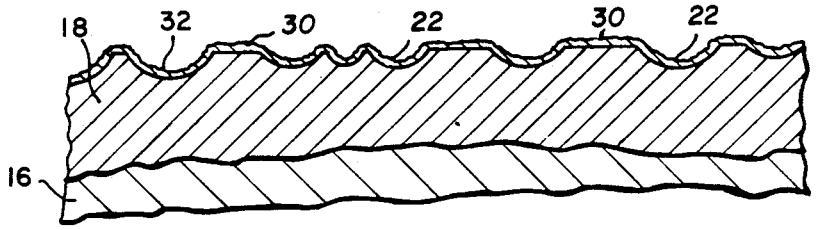
FIG. 5 is a cross section view similar to FIG. 4 after a layer of chromium has been electroplated on to the roller surface.
Figure 6:
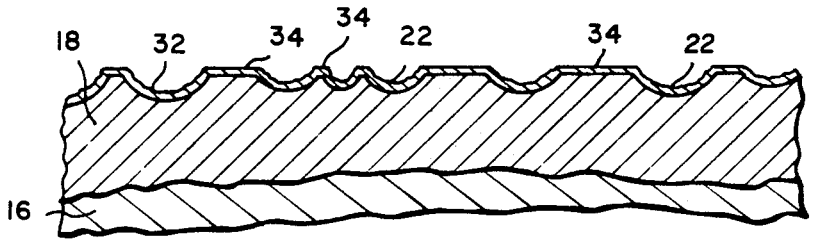
FIG. 6 is a sectional view similar to FIG. 5 after the chrome plated surface has been polished.

The roller is suitable for use after the superfinishing operation. However, in order to increase the durability of the roller surface it is preferred to cover the superfinished surface with a thin layer of a hard substance. More specifically, it is preferred to electroplate a layer 32 (FIG. 5) of chromium on the surface of the roller. Chromium is a hard, durable material and can be applied in a very thin layer. A chromium layer having a thickness of about 0.000100 inches is sufficient to provide a durable surface on the roller.

The step of electroplating a chromium layer onto the roller surface leaves a very fine roughness on the roller surface. This roughness is removed by polishing. The polishing step can be carried out by using a slurry comprising a suspension of 9 micron aluminum oxide polishing compound in water. The polishing step removes the roughness from the plateaus 34 of the chromium layer. It also leaves wall rounded edges on the plateaus so that the plateaus and edges thereof will not scratch or otherwise adversely affect a web travelling along the roller surface.

Figure 7:
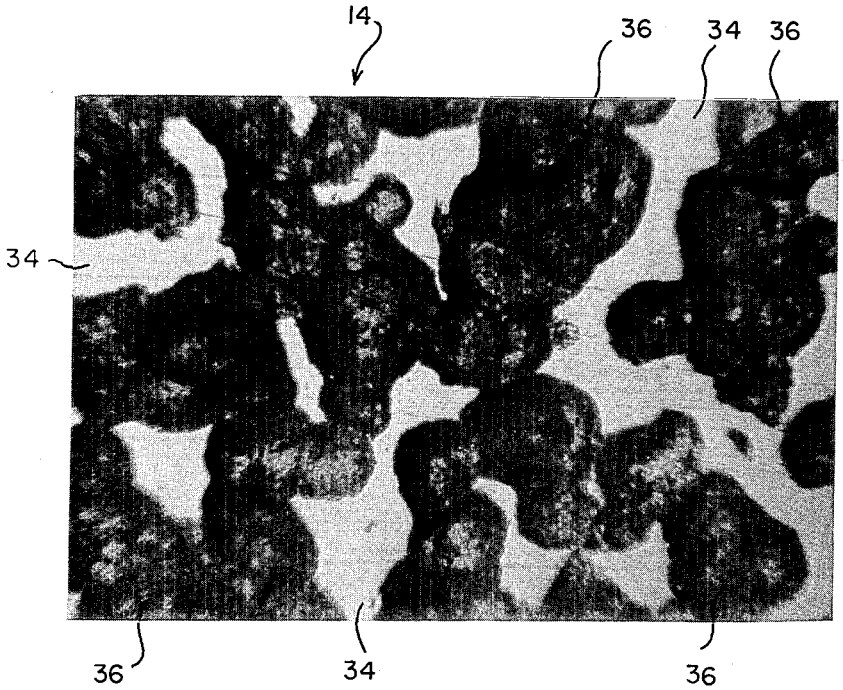
FIG. 7 is a photomicrograph of the surface of a roller of the invention.

FIG. 7 is a photomicrograph of a fragmentary portion of a surface 14 of the roller of the invention. The surface comprises the plateaus 34 and a plurality of channels 36. The channels are produced by connection of the down features 22 formed by the shot blasting operation. Most of the channels are interconnected to form pathways for air entrapped between the web 12 (FIG. 1) and the surface 14 of the roller. These pathways extend in a random manner both circumferentially and longitudinally along the roller. Thus air can travel both axially and circumferentially along the roller to escape from between the roller and the web. This assures good contact between the plateaus 34 and the surface of the web to obtain controlled traction or friction characteristics between the roller and the web. The traction between the roller and the web is predictable because very little air is entrained or trapped between the roller and the web. If significant amount of air became trapped between the roller and the web the traction characteristics of the roller would be adversely affected.

In order to obtain a traction characteristic greater than a ground roller finish, the shot blasted pattern of down features 22 preferably is greater than 500 microinches deep as determined by a 10 Rz paramater, and the surface pattern should have greater than 50% channeling (or less than 50% plateau areas 34) as determined by visual inspection of the surface. Preferably the depth of down features 22 in the final surface is less than about 1,000 microinches in order to facilitate cleaning of the roller surface. Except for concerns relating to cleanability, somewhat greater pattern depth could be used. In addition, the plateaus 34 preferably comprise greater than 20% of the surface area in order to eliminate the scratch potential of the pattern. The required pattern depth increases with increasing web velocity.

The random nature of the pathways on the surface of the roller is very desirable, especially for photographic products. More specifically, any slight marks produced on the web by such a random pattern will not be as readily observed by the human eye as a regular or repeating pattern of marks.

The invention has been described in detail with particular reference to a preferred embodiment thereof, but it will be understood that variations and modifications can be effected within the spirit and scope of the invention.

We claim:

1. A web conveyance roller comprising a steel core and a thin layer of nickel on the core, the nickel layer having a surface with generally spherical down features, the depth of the down features being greater than about 500 microinches but less than about 1000 microinches, many of the down features overlapping to form interconnected channels comprising at least 50% of the surface area of the roller, and a plurality of plateaus between the channels comprising at least 20% of the surface area of the roller.

2. A web conveyance roller comprising steel core, a layer of nickel on the core having a hardness less than about 50 HRC and a thickness of at least about 0.004 inches, the nickel layer having a surface with generally spherical down features, many of the down features overlapping of form interconnected channels comprising at least 50% of the surface area of the roller, a plurality of plateaus between the channels comprising at least 20% of the surface area of the roller, and the nickel layer being covered with a durable layer of chromium that is smooth and substantially free of roughness that would damage a web, the chromium layer having a thickness of about 0.000100 inches.

* * * * *